US012553175B2

(12) United States Patent
Griffin et al.

(10) Patent No.: US 12,553,175 B2
(45) Date of Patent: Feb. 17, 2026

(54) LAUNDRY WAND

(71) Applicants: Elena Griffin, Gainesville, FL (US); Marlon Griffin, Gainesville, FL (US)

(72) Inventors: Elena Griffin, Gainesville, FL (US); Marlon Griffin, Gainesville, FL (US)

( * ) Notice: Subject to any disclaimer, the term of this patent is extended or adjusted under 35 U.S.C. 154(b) by 0 days.

(21) Appl. No.: 17/803,444

(22) Filed: Jul. 11, 2022

(65) Prior Publication Data

US 2023/0013130 A1 Jan. 19, 2023

Related U.S. Application Data

(60) Provisional application No. 63/222,055, filed on Jul. 15, 2021.

(51) Int. Cl.
*D06G 3/02* (2006.01)

(52) U.S. Cl.
CPC ..... *D06G 3/02* (2013.01)

(58) Field of Classification Search
CPC ..... D06G 3/00; D06G 3/02; A47G 25/90–92; A47K 11/10
USPC ..... 223/39, 40, 41, 42
See application file for complete search history.

(56) References Cited

U.S. PATENT DOCUMENTS 890,885 A * 6/1908 Stuart ..... B25B 33/00 223/39
1,793,307 A * 2/1931 Dolan ..... A47K 11/10 15/188
2,626,090 A * 1/1953 Horsley ..... D06G 3/02 223/42
2,733,844 A * 2/1956 Gustavison ..... A47G 25/905 223/42
3,637,119 A * 1/1972 Blair ..... D06G 3/02 223/39
3,643,840 A * 2/1972 LeBlanc ..... D06G 3/02 223/42
3,746,220 A * 7/1973 Harbaugh ..... D06G 3/02 223/42
3,945,542 A * 3/1976 Taylor ..... D06G 3/02 223/42
4,620,649 A * 11/1986 Graham ..... D06G 3/02 223/42
4,749,111 A * 6/1988 Hardwick ..... D06G 3/02 223/42
D696,511 S * 12/2013 Fisette ..... D3/18
9,217,221 B2 * 12/2015 Catoe ..... A41D 27/20

* cited by examiner

*Primary Examiner* — F Griffin Hall
(74) *Attorney, Agent, or Firm* — Talem IP Law, LLP

(57) ABSTRACT

The invention presented is a device, the laundry wand, configured to be extended through a sleeve. The device comprises a longitudinal rod having two ends, with a malleable catching component designed to catch and hold the end of a garment arm or leg (collectively "sleeve") at the first end. When extended through a sleeve, the catching component holds the sleeve end enabling the sleeve to be inverted when the device is retracted through the length of the sleeve. The device may be used to turn the sleeve inside out or right-side in. The device provides the advantage of easily inverting the sleeve faster than being done manually.

6 Claims, 8 Drawing Sheets

LAUNDRY WAND

CROSS REFERENCE TO RELATED APPLICATIONS

This patent application claims the benefit under 35 U.S.C. § 119(e) of U.S. Provisional Application No. 63/222,055, filed Jul. 15, 2021, which application is incorporated herein by reference in its entirety.

FIELD OF THE INVENTION

The field of the invention generally pertains to the field of clothing care, more specifically to cleaning of clothing and still more specifically to cleaning of children's clothing.

BACKGROUND OF THE INVENTION

Parents, caretakers, homemakers and similar people who take care of children, especially infants, toddlers and small children are all familiar with the large amount of laundry generated by children. Infants and small children especially can easily produce more than one set of dirty clothes per day as well as using at least one set of clean sleepwear each night. When this clothing is removed, it usually ends up turned inside out even if the child knows how to take off his/her clothes without help. In addition, it is almost always easier to turn inside out the arms and legs (collectively "sleeves") of infant and toddler clothing rather than try to keep them right side in when removing them from small children.

Unfortunately, turning sleeves right side in for each piece of clothing is time consuming as well as tedious. It becomes more difficult when adults are reversing sleeves as their larger fingers and hands are trying to manipulate narrow legs and arms sized for infants and toddlers as well as small children.

Thus, what is needed is a device that will enable caregivers, parents and others who handle laundry to invert inside out sleeves to a right side in orientation quickly and easily and to allow them to avoid stretching the sleeves.

SUMMARY OF THE INVENTION

The invention broadly comprises a device for inverting a sleeve comprising a rod having a first end and a second end; and, a malleable catching component attached to the first end. The malleable catching component contacts an inner surface of the sleeve when the malleable catching component is inside the sleeve; and, the malleable catching component holds a cuff of the sleeve when retracted through the sleeve. In one embodiment, the malleable catching component is a plurality of flexible arms. In an alternate embodiment, the malleable catching component is a compressible head. In a second alternate embodiment, the malleable catching component is a plurality of flexible bristles.

One object of the invention is to provide a-device that enables a user to invert garment sleeves and legs, collectively sleeves, easily and quickly.

A second object of the invention is to supply a device that allows the efficient inversion of narrow sleeves.

DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
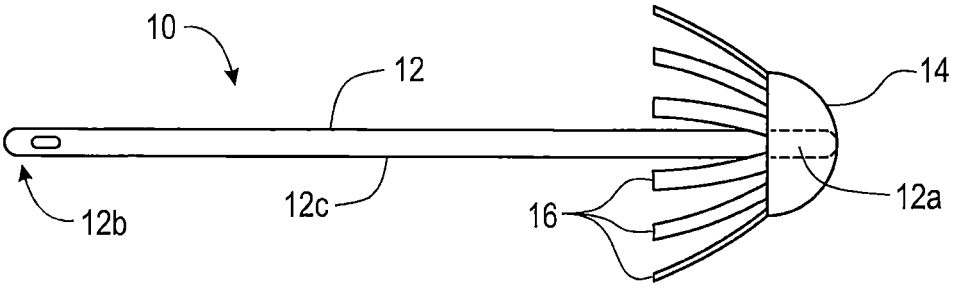
FIG. 1 is a side view of one embodiment of the present invention.

FIG. 1 is a front view of one embodiment of the laundry wand 10 ("wand 10") of the present invention. Rod 12 has a first end 12*a* and a second end 12*b*. Fastener 14 holds a plurality of flexible arms 16. FIG. 1 depicts a preferred embodiment of arms 16 in that the arms curve downward toward the body 12*c* of rod 12 when wand 10 is not in use. Laundry wand 10 is used to invert sleeves of garments. By inversion is meant, to reverse in position, order, or relationship. Thus, wand. 10 can be used to turn a sleeve inside out or right-side in. A sleeve is defined as a tubular part of a garment that covers an arm or a leg.

Figure 2:
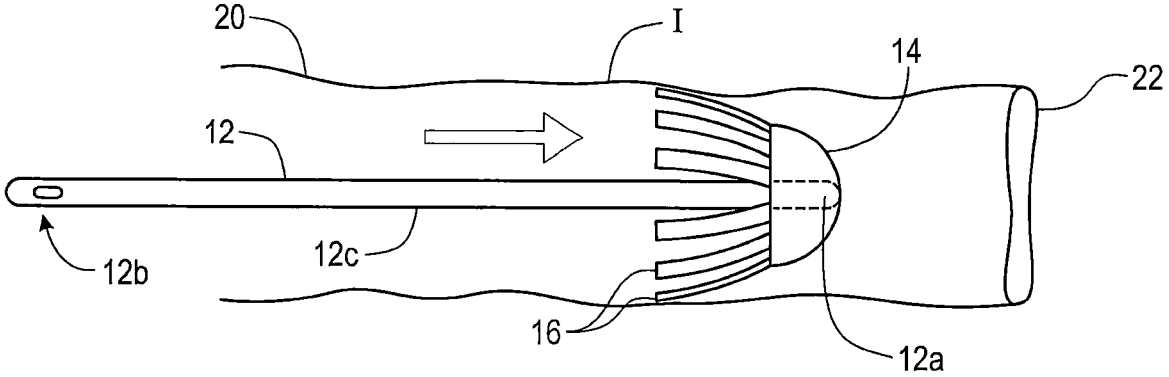
FIG. 2 is a side view of the laundry wand being inserted into a sleeve of a garment.
Figure 3:
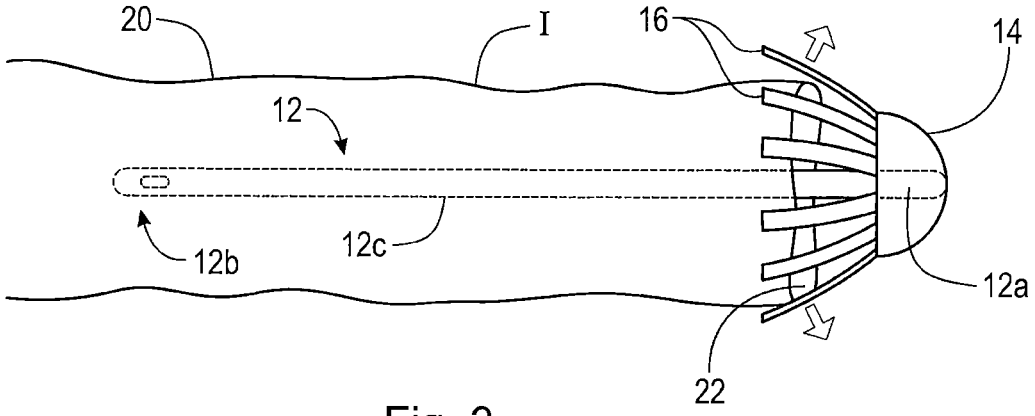
FIG. 3 is a view of the laundry wand seen in FIG. 1 with the plurality of flexible arms extending out of the sleeve.

FIG. 2 is a side view of the laundry wand 10 inserted into a sleeve 20 of a garment. Sleeve 20 is inside out as shown with inner surface I indicated on the outer surface of inverted sleeve 20. The arrow seen in FIG. 2 indicates the direction wand 10 is being pushed through sleeve 20. Wand 10 is moved through sleeve 20 until first end 12*a* and the plurality of arms 16 extends past sleeve edge 22 as seen in FIG. 3. The arrows in FIG. 3 show flexible or malleable arms 16 move outward from rod 16 after being compressed by sleeve 20 as wand 10 is pushed through sleeve 20.

Figure 4:
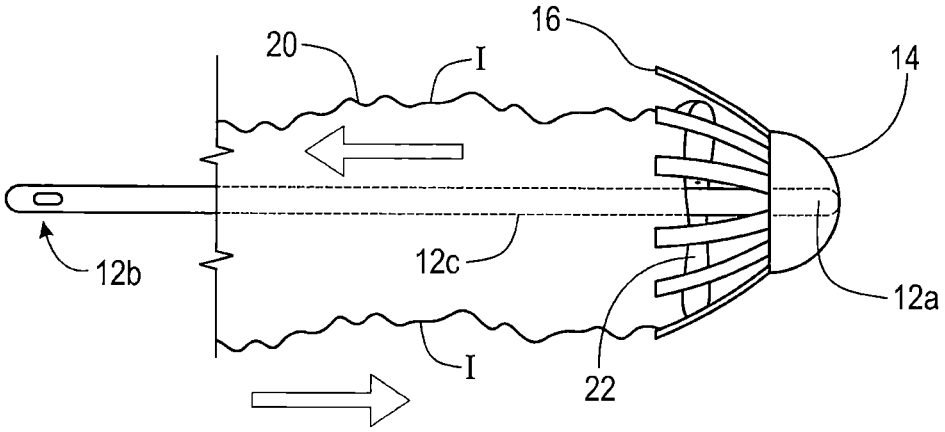
FIG. 4 shows the wand starting to be retracted and the inverted sleeve being pushed the reverse direction; and, FIG. 5 depicts the inverted orientation of the flexible arms as the wand is pulled back through the sleeve.

FIG. 4 depicts sleeve 20 starting to be inverted ("turned right-side in") as indicated by the arrow at the beginning of the wand 10 retraction through sleeve 20. It can be seen that preferably sleeve edge or cuff 22 is positioned between rod 12 and the undersurface of each of the plurality of arms 16 although wand 10 will invert sleeve 22 if a majority of the arms hold sleeve edge 22 between rod 12 and the arms 16 undersurfaces. In this regard, it is preferred that wand 10 includes three or more flexible arms 16 to ensure sleeve edge 22 is held securely during the inversion procedure. It can be seen in FIGS. 1-5 that the terminal ends of each of the arms 16 is smooth meaning having a regular surface with no bumps or projections. See https://www.merriam-webster-.com/dictionary/smooth. "Terminal" can be defined as of or relating to an end, extremity, boundary, or terminus. See https://www.merriam-webster.com/dictionary/terminal. In this case the unattached end of the arms 16 are terminal ends as defined above. The left-pointing arrow seen in FIG. 4 shows that wand 10 is pulled in the reverse direction within sleeve 20. Preferably, as wand 10 is pulled in the reverse direction, sleeve 20 is held in place or moved in the opposite direction as wand 10 is being pulled as shown by the right-pointing arrow.

Figure 5:
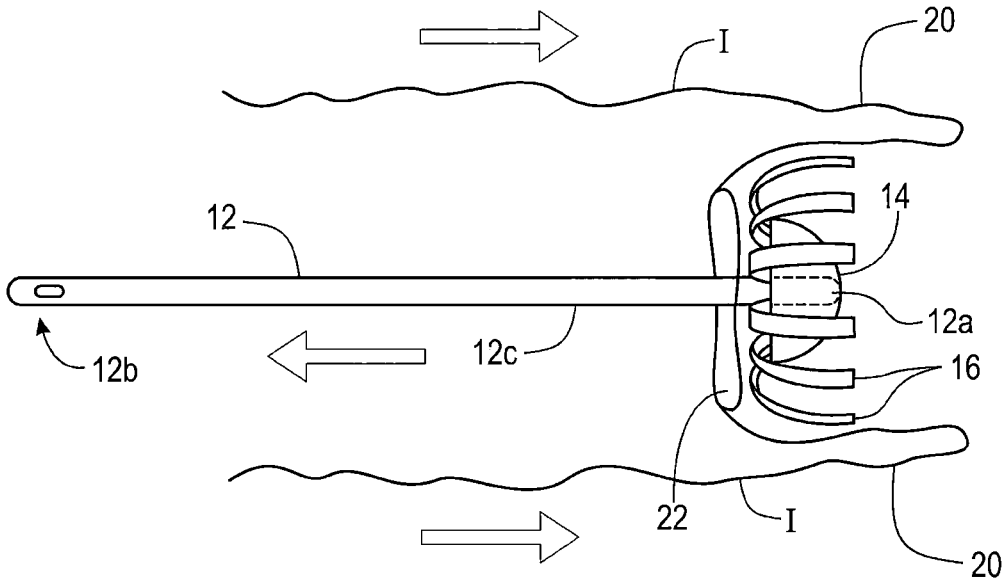

FIG. 5 depicts the inverted orientation of the flexible arms as the wand is pulled back through the sleeve. As wand 10 is pulled back in sleeve 20, arms 16 are pulled over first end 12*a* and are held in this flipped position by the inner surface of sleeve 20, while sleeve edge 22 is maintained in its original trapped position between rod 12 and inverted arms 16 near first end 12*a*. As wand 10 is retracted, sleeve 20 is reoriented from an inside out position to a right-side in position. For clarity, sleeve 20 is shown some distance away from arms 16, but persons of skill in the art will recognize that sleeve 20 will contact arms 16 as wand 10 is being retracted.

Figure 6:
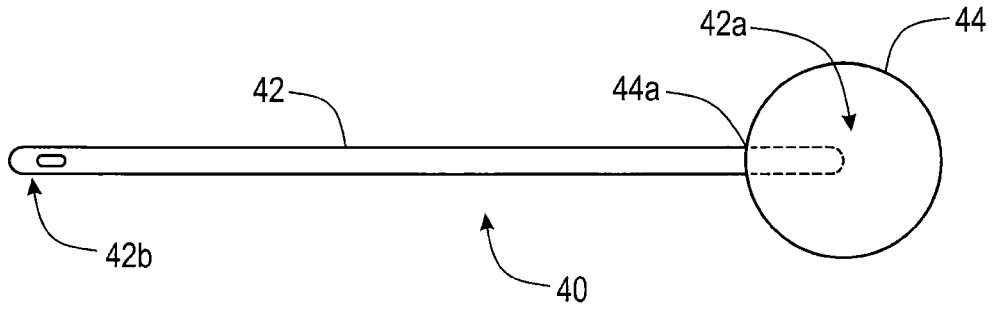
FIG. 6 shows an alternate embodiment of the laundry wand having a compressible head at one end of the wand.
Figure 7:
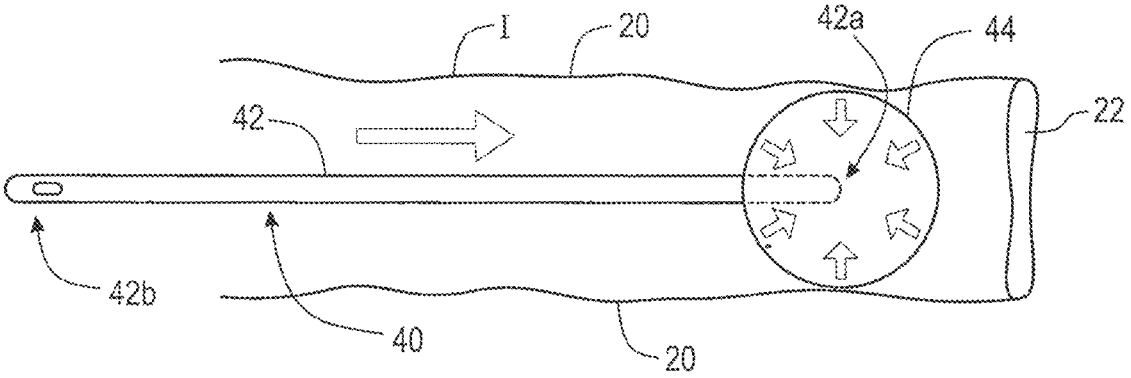
FIG. 7 depicts the alternate embodiment being pushed through a sleeve with the malleable head compressed by the sleeve.

FIG. 6 shows an alternate embodiment of the inventive laundry wand 40 having a compressible head 44 at first end 42*a* of the rod 42 opposite second end 42*b*. Compressible head 44 is attached to rod 42 at first end 42*a* using a fastening means 44*a*. Examples of fastening means 44*a* include, but are not limited to, a friction fit between rod 42 and head 44, a threaded attachment with first end 42*a* threaded into head 44 or vice versa, and glue or other adhesive holding rod 42 to head 44 at first end 42*a*. Compressible head 44 may be any suitable compressible material such as, but not limited, to rubber or foam rubber, that can be compressed to pass through a sleeve then expand to its original dimensions after head 44 extends past the edge of the sleeve. FIG. 7 depicts wand 40 being pushed through an inside out sleeve 20 with the internal arrows inside head 44 signifying it is being compressed to squeeze through narrow sleeve 20.

Figure 8:
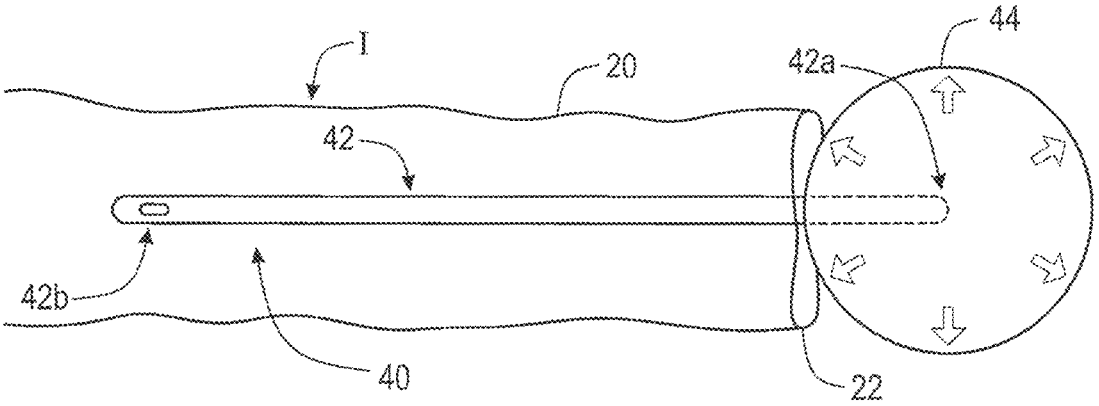
FIG. 8 shows the wand with the compressible head extended past the cuff of the sleeve with the head expanded to its original dimensions.
Figure 9:
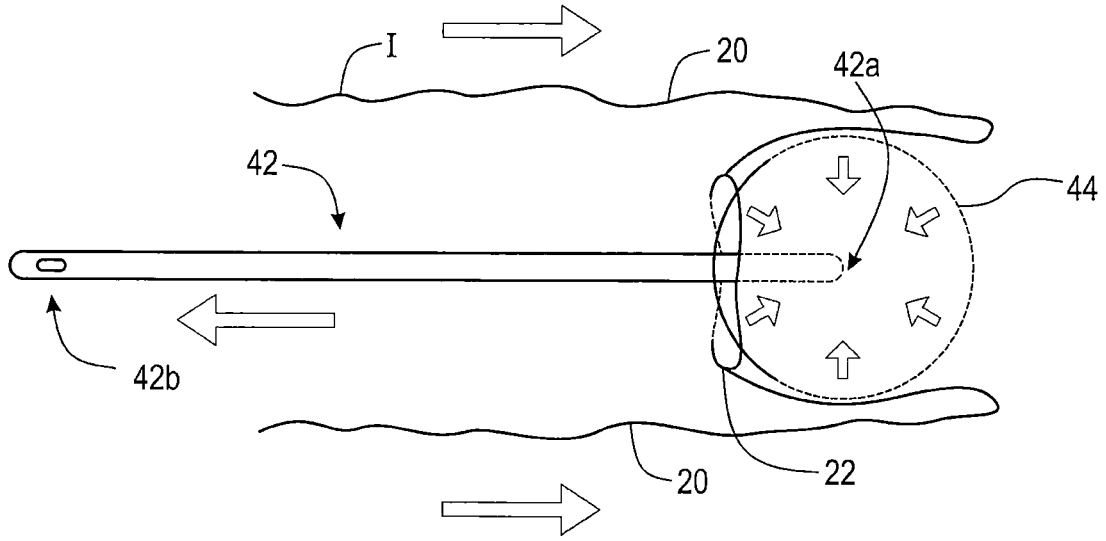
FIG. 9 shows the wand being retracted through the sleeve with the head compressed by the sleeve.

FIG. 8 shows wand 40 with compressible head 44 extended past cuff 22 of inside-out sleeve 20. Inner sleeve surface I ("surface I") forms the outer surface of inverted sleeve 20 indicating sleeve 20 is inside-out. The internal arrows of head 44 show it rexpanded to its original larger dimensions. Note that cuff 22 is caught and held near the attachment of rod 42 to head 44. FIG. 9 shows the wand 40 being retracted through the sleeve 20 with cuff 22 held in place against compressible head 44. During retraction, head 44 is again compressed inside sleeve 22. Note that inner sleeve surface I is inverted to the inside of the sleeve with the noninverted surface I still on the outside of sleeve 20 as wand 40 is pulled back out of sleeve 20. Preferably, sleeve 20 is held in place or pushed in the opposite direction of the retraction of wand 40 as indicated by the rightward pointing arrows.

Figure 10:
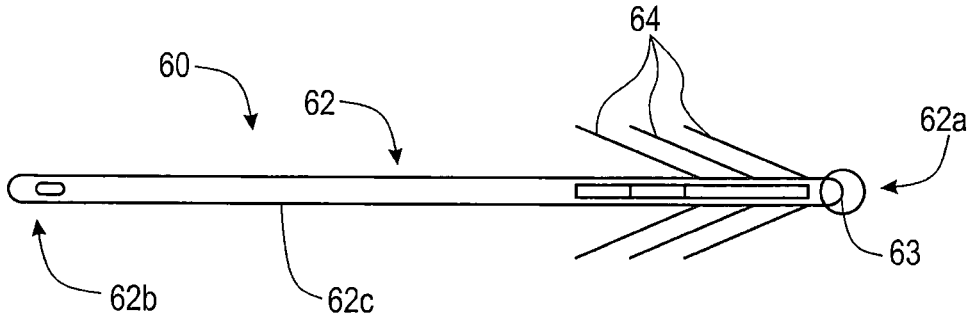
FIG. 10 is a side view of a second alternate embodiment of the laundry wand of the present invention having a plurality of flexible bristles at one end of the wand.
Figure 11:
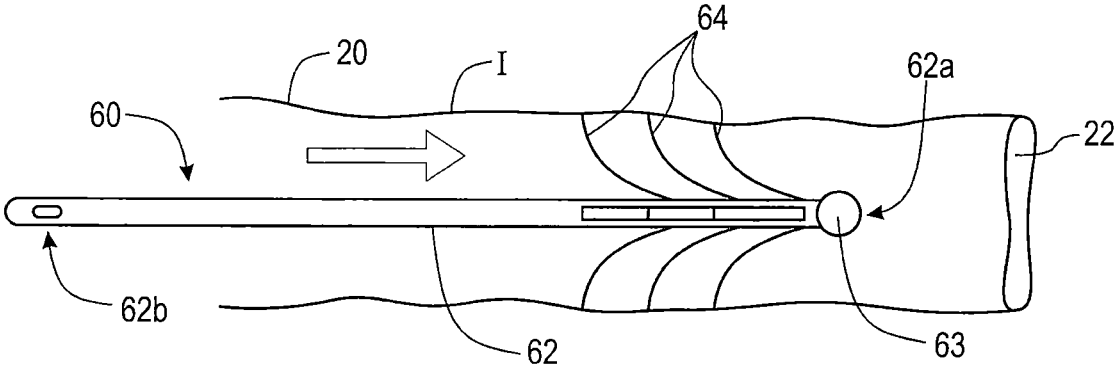
FIG. 11 depicts the second alternate embodiment being pushed through a sleeve.

FIG. 10 is a side view of a second alternate embodiment of the laundry wand of the present invention in which laundry wand 60 possesses a plurality of flexible bristles 64 at first end 62*a* of wand 60. FIG. 10 also shows an alternate embodiment in which a blunt head 63 is positioned proximate first end 62*a* which enables wand 60 to pass through sleeve 20 more easily. FIG. 11 depicts wand 60 being pushed through an inside out sleeve 20 with bristles 64 being pushed toward or against rod 62 by sleeve 20 allowing wand 60 to be pushed easily through a narrow sleeve 20. Inner sleeve surface I forms the outer surface of sleeve 20 indicating sleeve 20 is inside out. FIG. 11 also depicts a blunt head 63 that, can be used to push wand 60 through sleeve 20 more easily.

Figure 12:
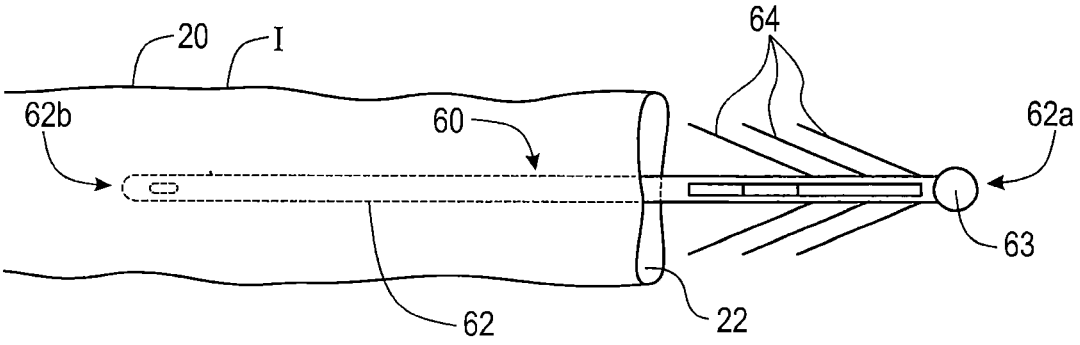
FIG. 12 is a side view showing the flexible bristles extended past the cuff of the sleeve.
Figure 13:
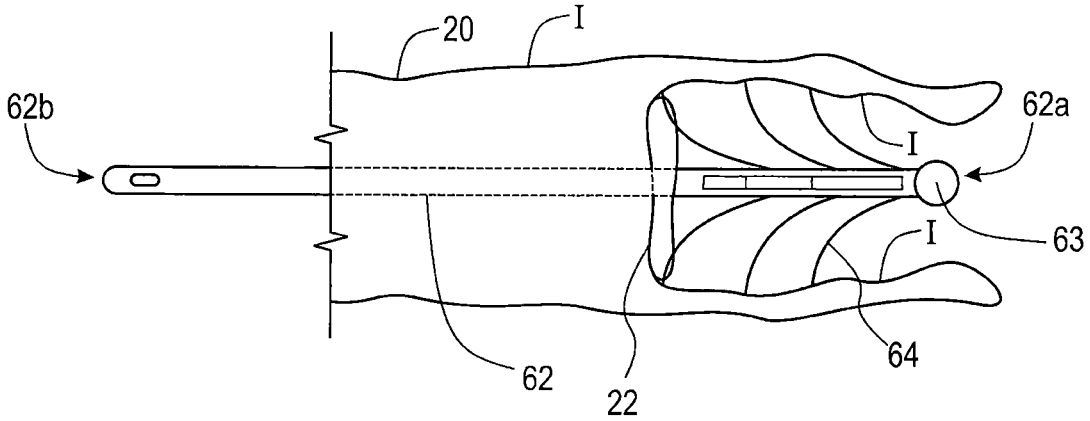
FIG. 13 shows the laundry wand being retracted out of the sleeve.

FIG. 12 is a side view showing flexible bristles 64 extended past cuff 22 of sleeve 20 with cuff 22 caught under bristles 64. FIG. 13 shows wand 60 being retracted through sleeve 20 with cuff 22 held in place by flexible bristles 64. Similar to FIG. 9, inner surface I of sleeve 20 is pulled to the inside of sleeve 20 as wand 60 is retracted.

Figure 14A:
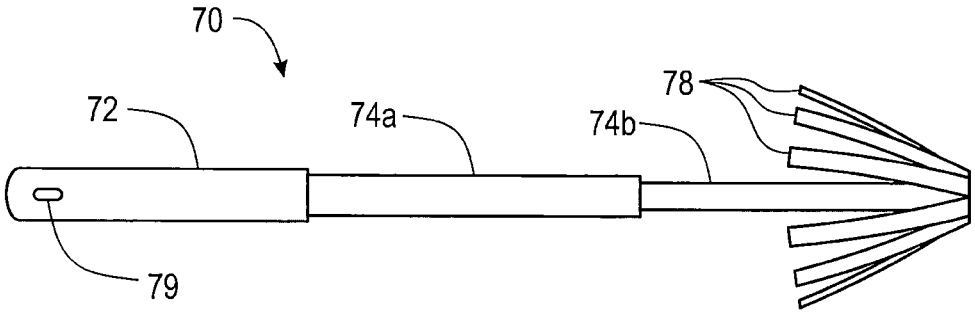
FIG. 14A is a side view of an alternate embodiment of the inventive laundry wand including a body with a retractable handle; and, FIG. 14B depicts a similar view as FIG. 14A showing the retractable handle in the closed position.
Figure 14B:
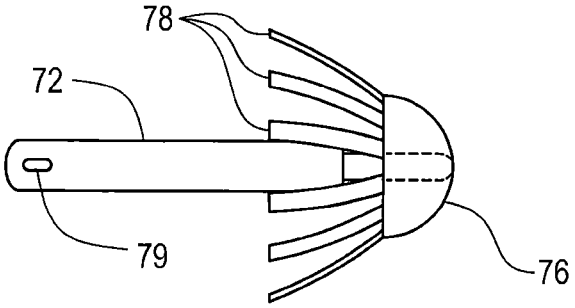

In an alternate embodiment shown in FIG. 14A, wand 70 is shown with a retractable rod 72 with retracting/expanding sections 74*a* and 74*b*. Flexible arms 78 are seen on one end of to section 74*b* to form a malleable catching component similar to that seen in wand 10. Persons of skill in the art will recognize that other malleable catching components such as those seen with wands 40 and 60 can be used with a retractable rod 72. Button 79 represents a button used to extend and retract rod 72 similar to the mechanism in a collapsible umbrella. FIG. 14B shows sections 74*a* and 74*b* retracted into rod 72. Wand 70 provides an advantage to the user as in that it enables a user to adjust the length of rod 72 to the length of sleeves to be inverted. It also makes it easier to store and carry wand 70 when not in use.

Laundry wands 10, 40, 60 and 70 (collectively "wands 10") each provide a device with a malleable head or catching component that enables a user to change sleeves from an inside out to a right-side in orientation (or vice versa) quickly and efficiently. By malleable is meant a part having a capacity of adaptive change. The advantage is seen especially, but not exclusively, in infant clothes and toddler clothes ("clothes") which have narrow leg and arm sleeves. Typical examples are pajamas, shirts, sweaters, onesies, pants, etc. or any clothing item with narrow sleeves. It is well known that when taking off these types of clothes from toddlers and infants, usually the sleeves (both for legs and arms) are turned inside out. In addition, babies and toddlers generate a large amount of inside out clothing because they use several garments every day. Rather than turn these clothes with narrow sleeves right-side in by hand, laundry wands 10 provide the advantage of a faster and simpler method of turning clothes into a proper right-side in orientation. Persons of skill in the art will recognize laundry wands 10 of appropriate size can be used with sleeves of any size. By appropriate is meant especially suitable or compatible.

Persons of skill in the art will also recognize that use of wands 10, 40, 60 and 70 will prevent the widening of sleeves in toddler and infant clothing by eliminating stretching of sleeves caused by the use of adult sized hands.

Thus, it is seen that the objects of the invention are efficiently obtained, although changes and modifications to the invention should be readily apparent to those having ordinary skill in the art, which changes would not depart from the spirit and scope of the invention as claimed.

We claim:

1. A laundry wand comprising:

a rod having a first end and a second end;

an end cap at the first end and having a cap shape, wherein the rod attaches to an undersurface of an apex of the end cap, wherein a diameter of a base of the end cap is larger than a diameter of the rod; and a plurality of flexible arms coupled to the first end of the rod and extending down a length of the rod towards the second end when in an at-rest state, wherein each flexible arm of the plurality of flexible arms is manipulatable to bend back towards the first end of the rod such that a rod-facing surface of that flexible arm is able to face away from the rod when manipulated.

2. The laundry wand of claim 1, wherein the plurality of flexible arms extend radially outward from the base of the end cap towards the second end when in the at-rest state.

3. The laundry wand of claim 1, wherein a distal diameter formed by the plurality of flexible arms in the at-rest state is larger than the diameter of the base of the end cap.

4. The laundry wand of claim 1, wherein an inner circular region formed by rod-facing surfaces of the plurality of flexible arms is configured to catch on a cuff of a sleeve for which the laundry wand is used to invert when the plurality of flexible arms is in the at-rest state.

5. The laundry wand of claim 1, wherein a circular area formed by distal ends of the plurality of flexible arms has a first diameter when in the at-rest state and a second, smaller diameter when in a compressed state.

6. The laundry wand of claim 1, wherein the rod is a retractable rod.

* * * * *